US007795519B2

(12) United States Patent
Hsien

(10) Patent No.: US 7,795,519 B2
(45) Date of Patent: Sep. 14, 2010

(54) ENHANCED LOW-NOISE DRUM TYMPAN

(76) Inventor: Chao-Ying Hsien, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 12/061,632

(22) Filed: Apr. 2, 2008

(65) Prior Publication Data

US 2009/0249940 A1 Oct. 8, 2009

(51) Int. Cl.
*G10D 13/02* (2006.01)

(52) U.S. Cl. ..... 84/414

(58) Field of Classification Search ..... 84/414
See application file for complete search history.

(56) References Cited

U.S. PATENT DOCUMENTS

| | | | | | |
|---|---|---|---|---|---|
| 729,936 | A * | 6/1903 | Heybeck | 84/414 |
| 1,018,767 | A * | 2/1912 | Logan | 84/414 |
| 4,308,782 | A * | 1/1982 | Hartry | 84/414 |
| 4,770,918 | A * | 9/1988 | Hayashi | 428/113 |
| 4,798,121 | A * | 1/1989 | Donohoe | 84/414 |
| 6,365,812 | B1 * | 4/2002 | McGill | 84/414 |
| 6,756,535 | B1 * | 6/2004 | Yoshino et al. | 84/738 |
| 6,784,352 | B2 * | 8/2004 | Suenaga | 84/411 R |
| 6,921,857 | B2 * | 7/2005 | Yoshino et al. | 84/738 |
| 7,385,135 | B2 * | 6/2008 | Yoshino et al. | 84/738 |
| 7,514,617 | B2 * | 4/2009 | Rogers et al. | 84/411 P |
| 2006/0207296 | A1 * | 9/2006 | Fujikawa | 66/202 |
| 2009/0000464 | A1 * | 1/2009 | Mishima | 84/724 |
| 2009/0249940 | A1 * | 10/2009 | Hsien | 84/414 |

* cited by examiner

*Primary Examiner*—Jeffrey Donels
*Assistant Examiner*—Robert W Horn

(57) ABSTRACT

An enhanced low-noise drum tympan comprises at least two net bodies which are combined to a drum frame; the net bodies being combined by adhesive and being rolled as an integral body. The net bodies are selected from knitted fabrics nets, woven fabrics nets or the combination of knitted fabrics nets and woven fabrics nets. The knitted fabrics net is formed by only wide fabric strips or narrow fabric wires. The knitted fabrics net is formed by intersection of wide fabric strips and narrow fabric wires.

1 Claim, 10 Drawing Sheets

ENHANCED LOW-NOISE DRUM TYMPAN

FIELD OF THE INVENTION

The present invention relates to drums, in particular to an enhanced low-noise drum tympan comprising at least two net bodies which are combined to a drum frame; the net bodies being combined by adhesive and being rolled as an integral body.

BACKGROUND OF THE INVENTION

Jazz drums are popular drums, but they will generate a great noise to the environment, especially to a residential district. Although the sound isolation chamber can resolve some of the problems, the cost for the chamber is low. Thus not every user can overcome the problem of noise by this way. Low-noise drum tympan is developed, in that no polyester film is used, but nets are used, which has the same effect as the film, while the noise is very low and it can provide the same feeling to the users. Thus the low-noise drum tympan is widely used in training for reducing the noise to the environment.

However the prior art low-noise drum tympan is made of many layers of nets which are overlapped. The nets are expanded and are installed to the drum frame. Gaps are formed between the nets. Thus in beating the nets will collide to one another so as to generate noise. Furthermore, for a long time, the nets will break and thus the lifetime is short. The feeling for beating is bad.

Furthermore, when the tympan is added to a pickup device, hairs are generated in the holes so that it is difficult in manufacturing.

SUMMARY OF THE INVENTION

Accordingly, the object of the present invention is to provide an enhanced low-noise drum tympan which comprises at least two net bodies combined to a drum frame; the net bodies being combined by adhesive and being rolled as an integral body. The net bodies are selected from knitted fabrics nets, woven fabrics nets or the combination of knitted fabrics nets and woven fabrics nets. The knitted fabrics net is formed by only wide fabric strips or narrow fabric wires. The knitted fabrics net is formed by intersection of wide fabric strips and narrow fabric wires.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Figure 4:
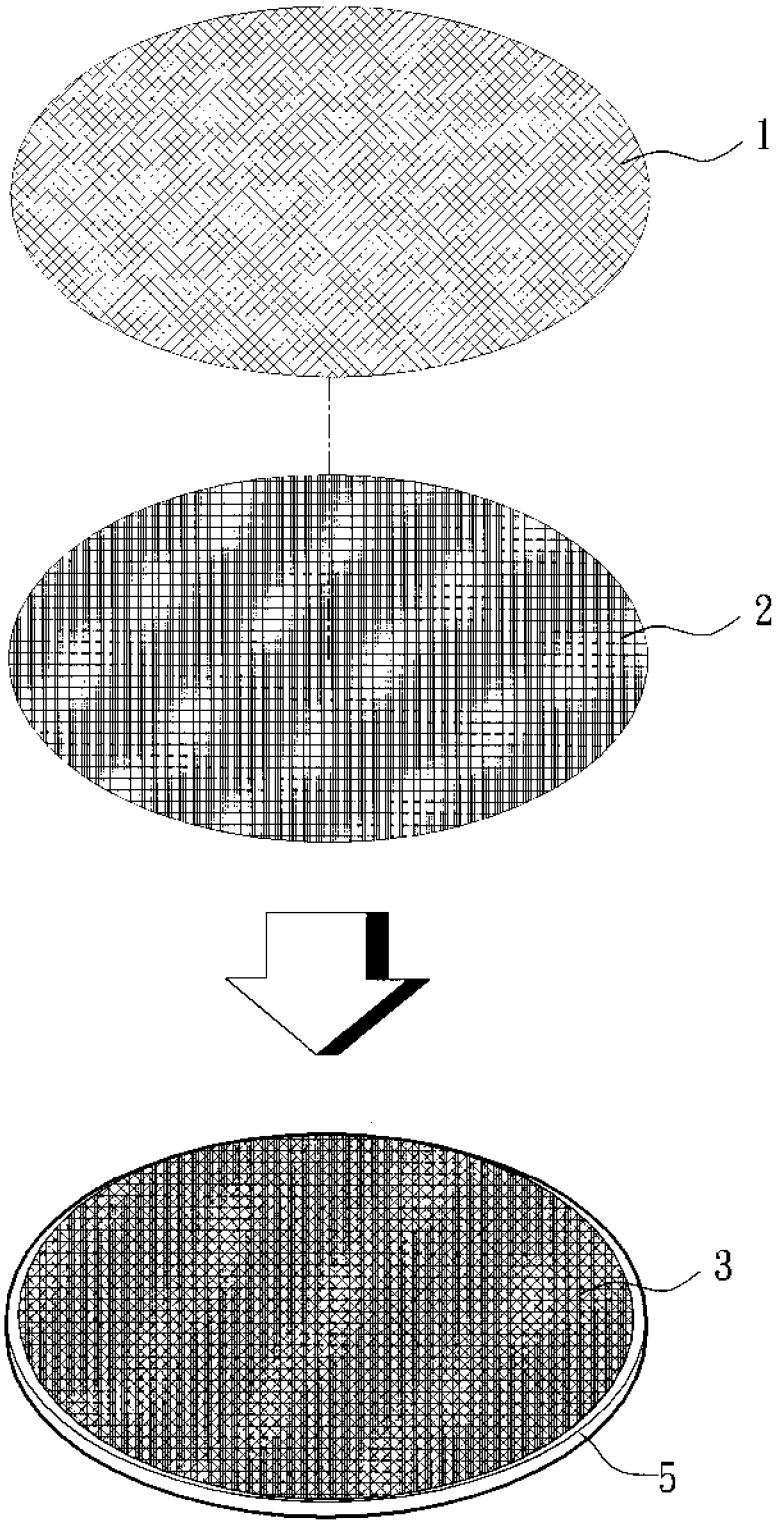
FIG. 4 is a structural schematic view about the low-noise drum tympan of the present invention.
Figure 6:
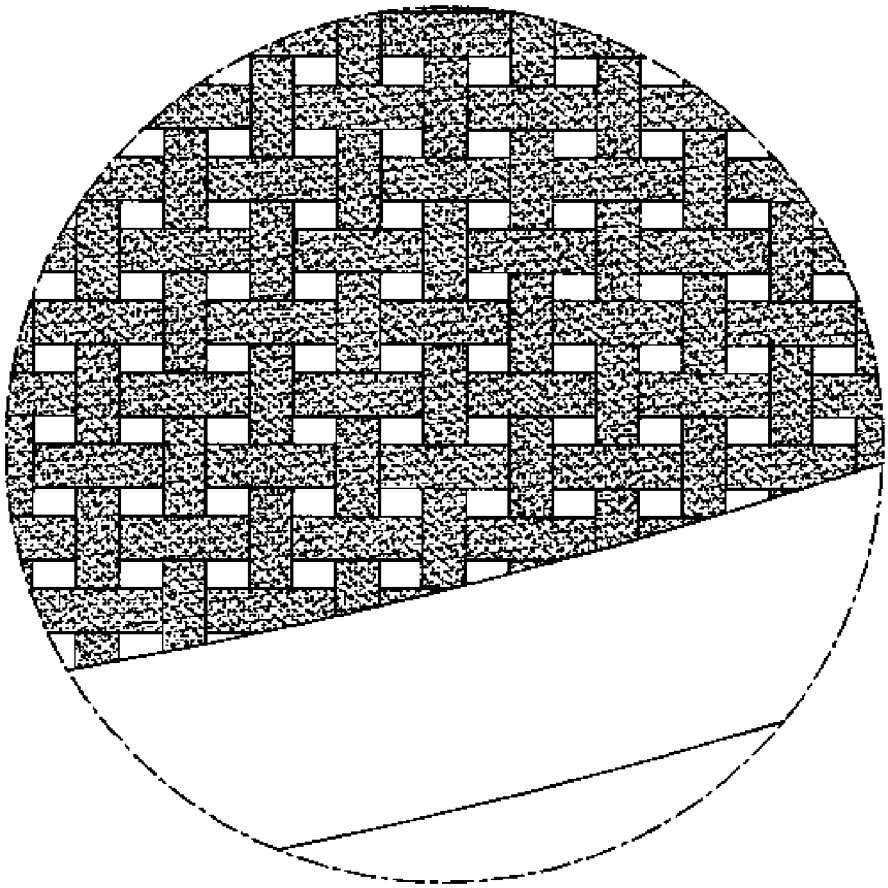
FIG. 6 is a structural schematic view of the knitted fabrics net of the present invention.
Figure 7:
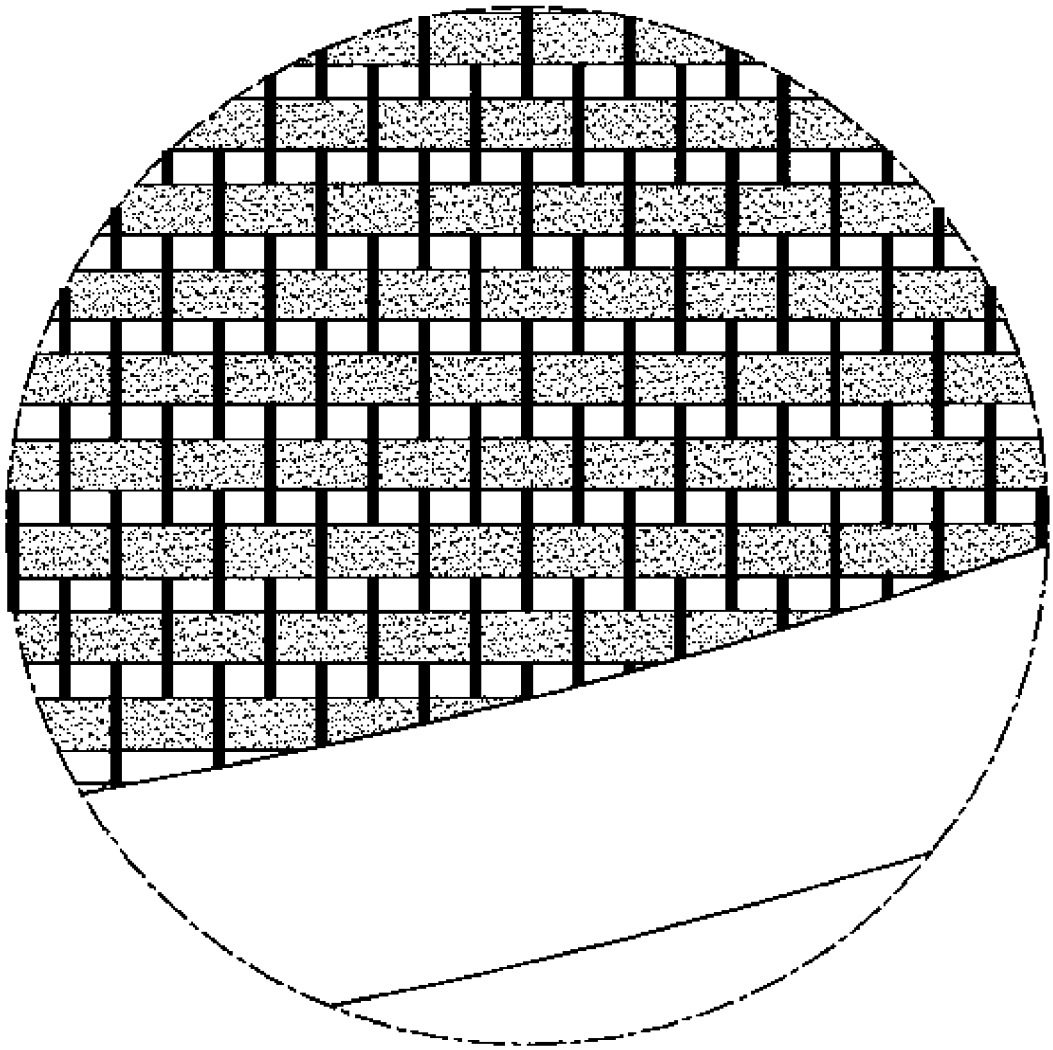
FIG. 7 is another structural schematic view of the knitted fabrics net of the present invention.

Referring to FIG. 4, a schematic view showing the structure of the present invention is illustrated. The low-noise drum tympan 3 is formed by two net bodies 1, 2. The net bodies 1, 2 may be knitted fabrics nets or woven fabrics nets or one is a knitted fabrics net and another is a woven fabrics net. The knitted fabrics net B may be formed by only wide fabric strips or narrow fabric wires, as illustrated in FIG. 6; or as illustrated in FIG. 7, it is formed by intersection of wide fabric strips and narrow fabric wires.

Figure 1:
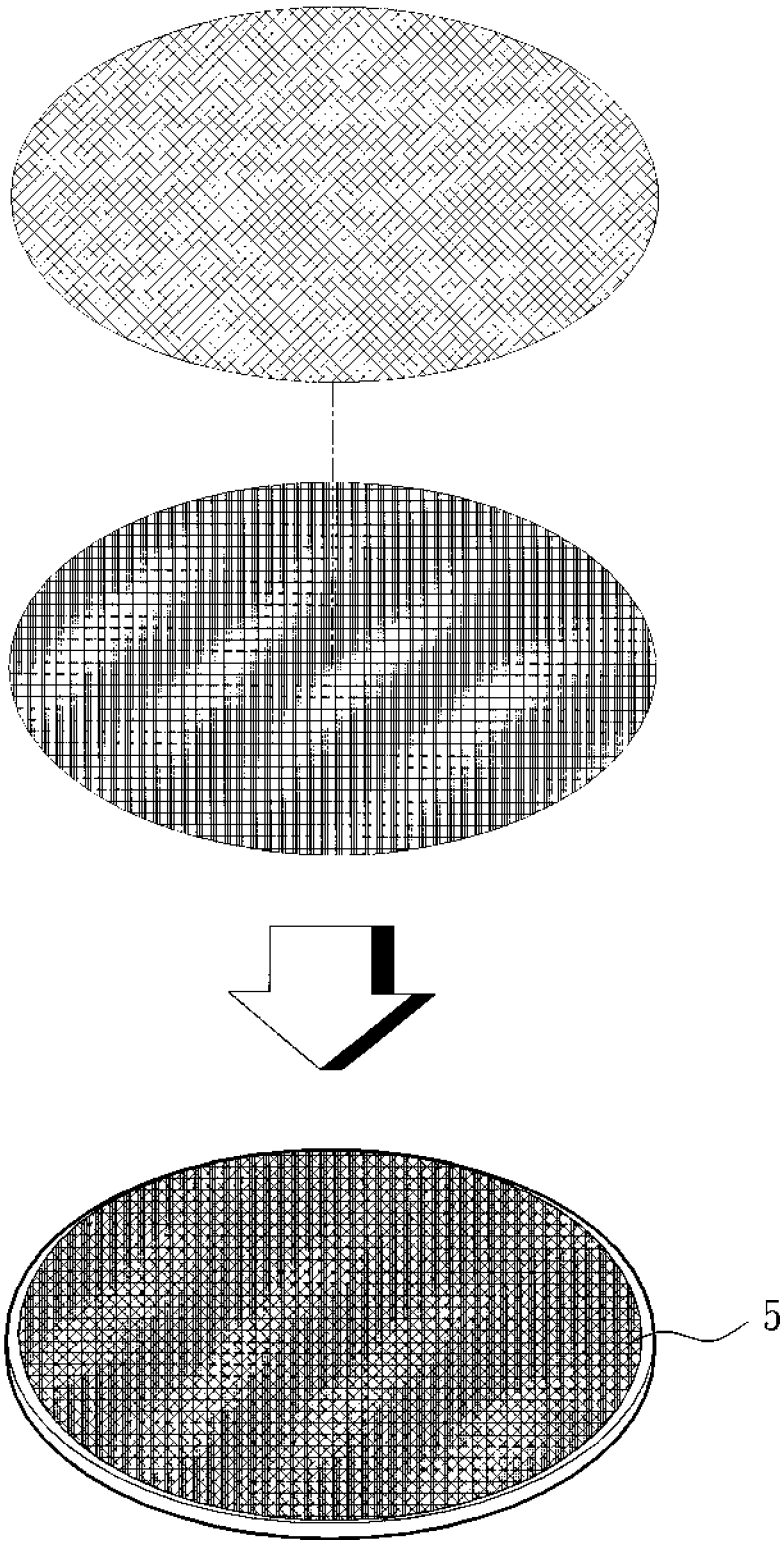
FIG. 1 is a schematic view showing the structure of a prior art low-noise drum tympan.
Figure 2:
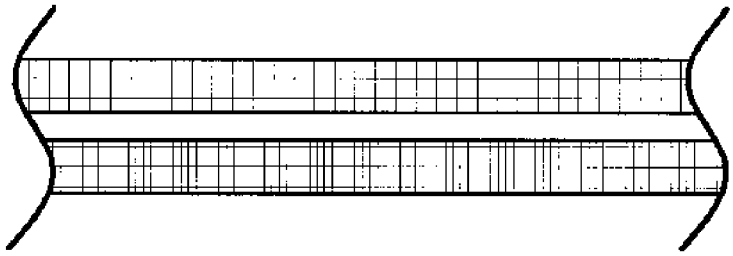
FIG. 2 is a partial cross sectional view of FIG. 1.
Figure 5:
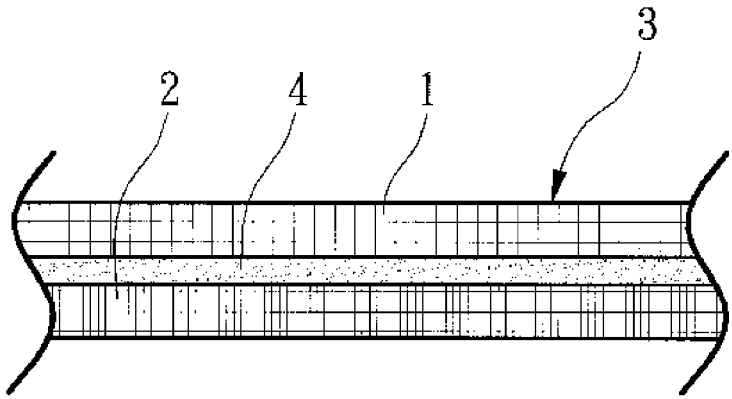
FIG. 5 is a partial cross sectional view of the structure in FIG. 4.
Figure 3:
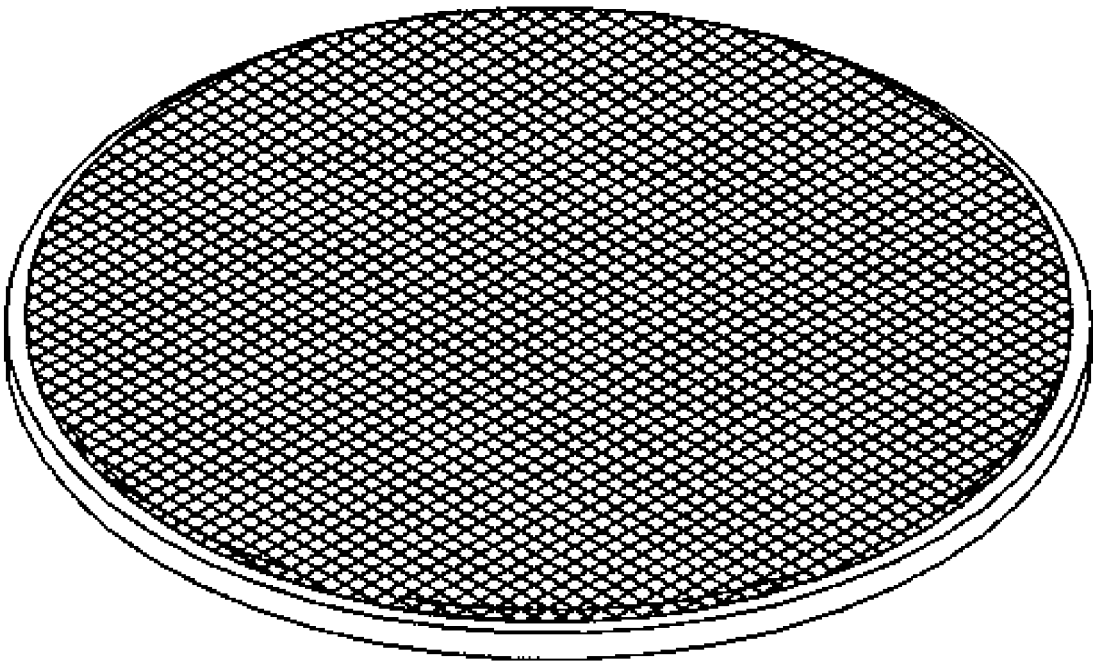
FIG. 3 is a schematic view of a woven fabrics net.

Referring to FIG. 5, adhesive 4 is coated between the two net bodies which are then combined by rolling as a combination body. Then the combination body is assembled to a drum frame 5 for shaping and further working.

Therefore, by the structure of the present invention, the net bodies 1, 2 of the low-noise drum tympan 3 can be combined tightly. In beating, the net bodies will not collide to one another so as not to break. Furthermore, no noise generates. Furthermore, the addition of a pickup device, or connectors, no hair generates.

When the low-noise drum tympan 3 is formed by knitted fabrics net and woven fabrics net, the knitted fabrics net has low elasticity, so that it provides a preferred beating feeling without the defect of over-high elasticity.

Figure 8:
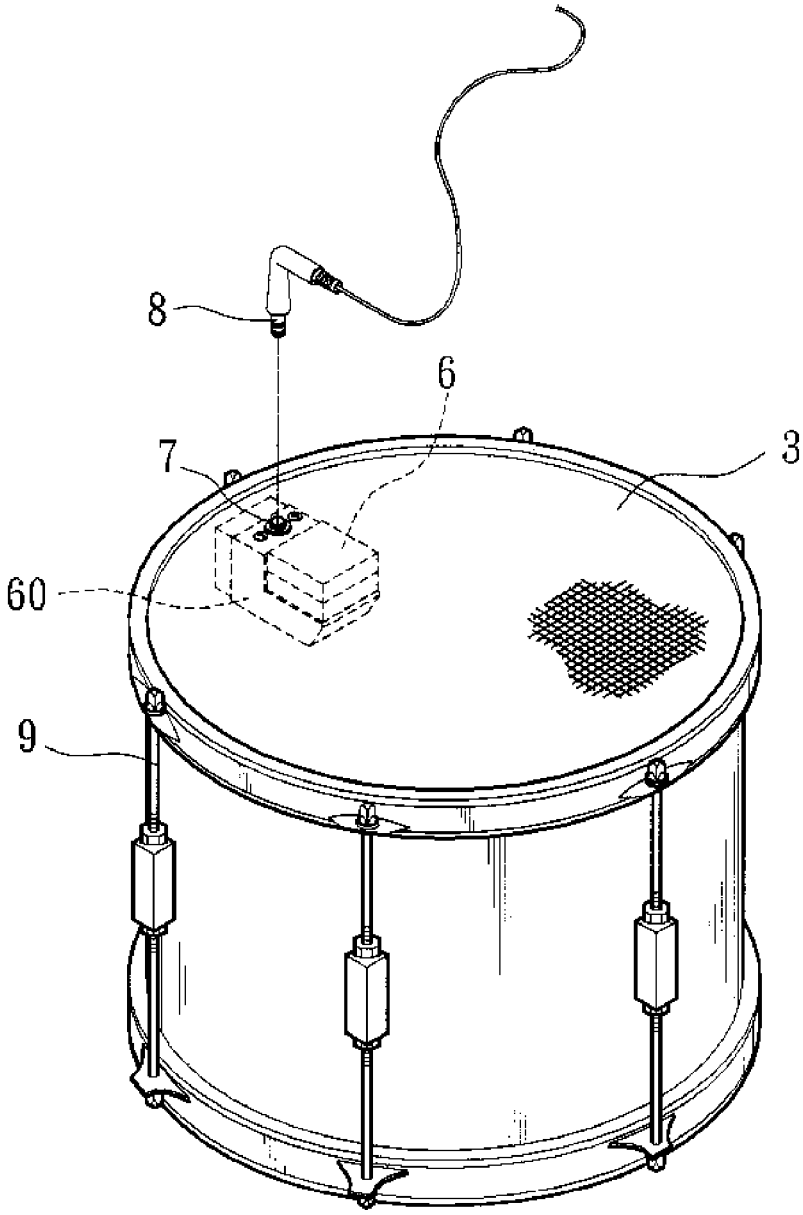
FIG. 8 is a schematic view showing that the present invention is installed to a drum.
Figure 9:
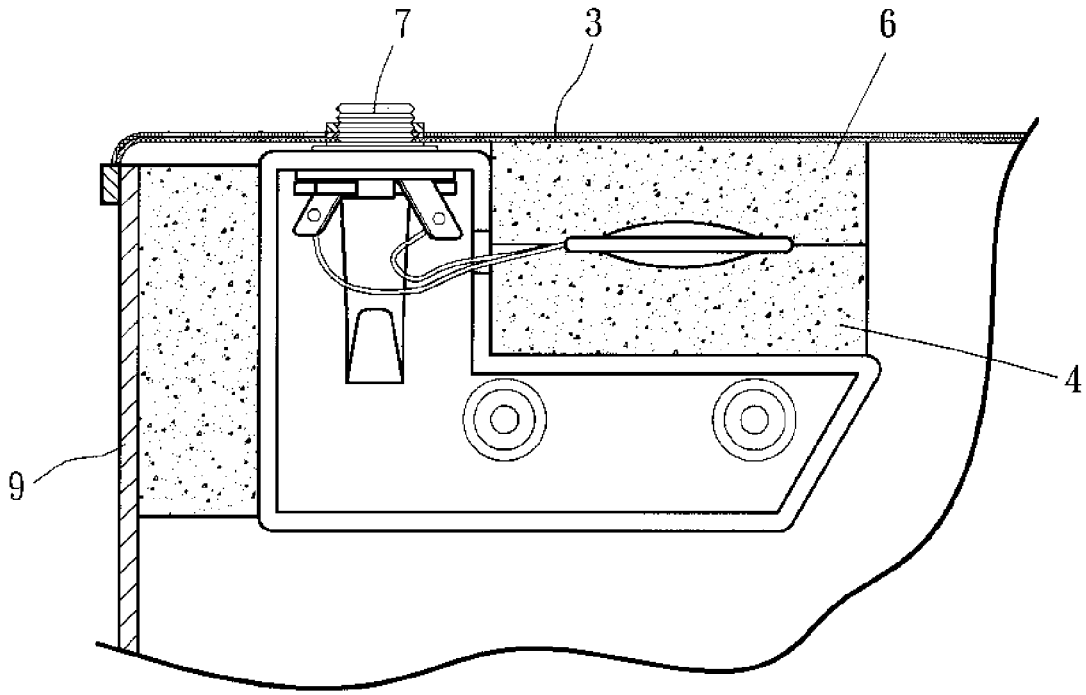
FIG. 9 is a cross sectional view showing the structure of FIG. 8.

Referring to FIGS. 8 and 9, the low-noise drum tympan 3 of the present invention can be used with the pickup device and supporting seat in U.S. Pat. No. 7,259,317 assigned to the inventor of the present invention (the pickup device has a numeral of 6 and the supporting seat has a numeral of 60 in FIGS. 8 and 9). In that, the low-noise drum tympan 3 of the present invention can be directly used with the pickup connector 7 and the supporting seat so as to be connected to a joint 8 to have a preferred effect.

Figure 10:
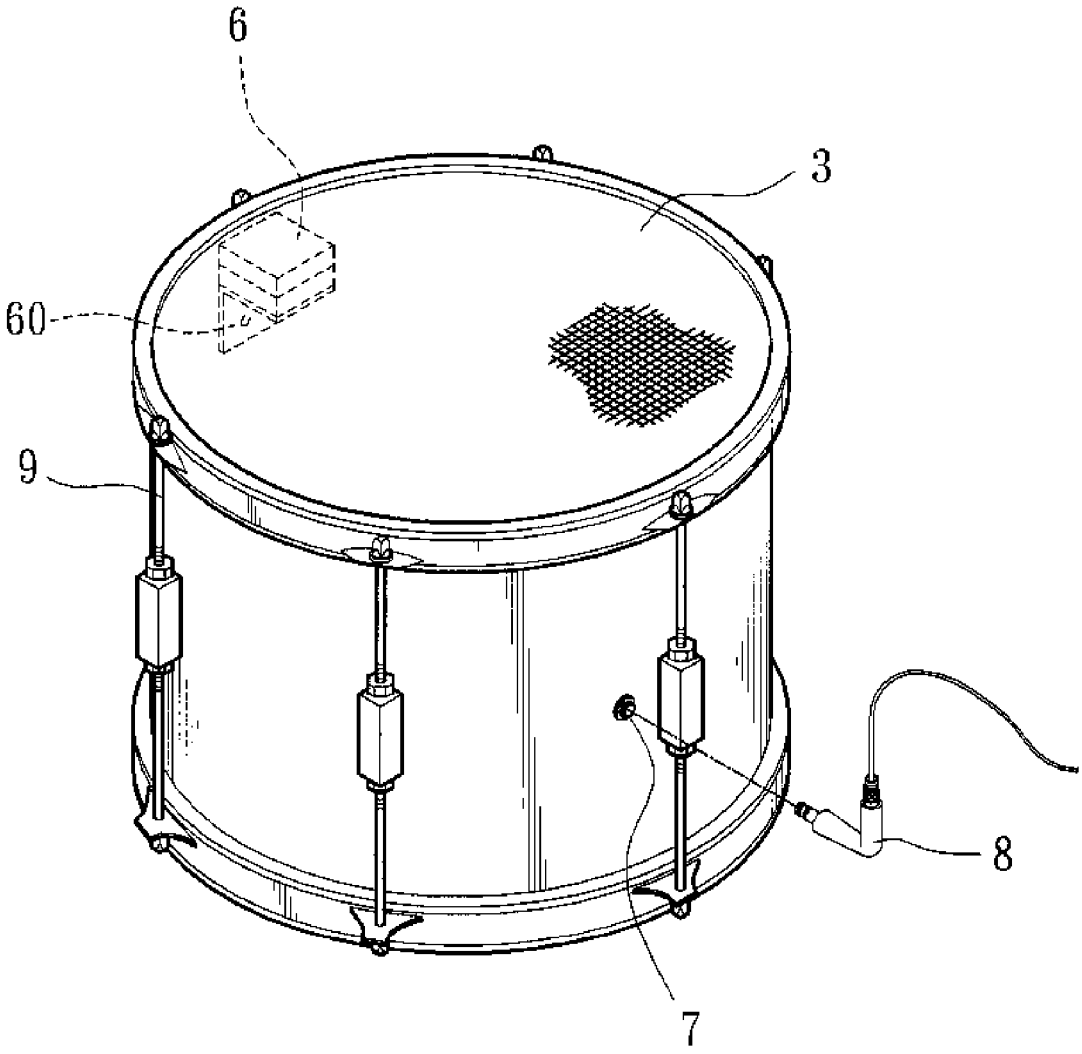
FIG. 10 is another schematic view about the installation of the present invention installed to the drum.
Figure 11:
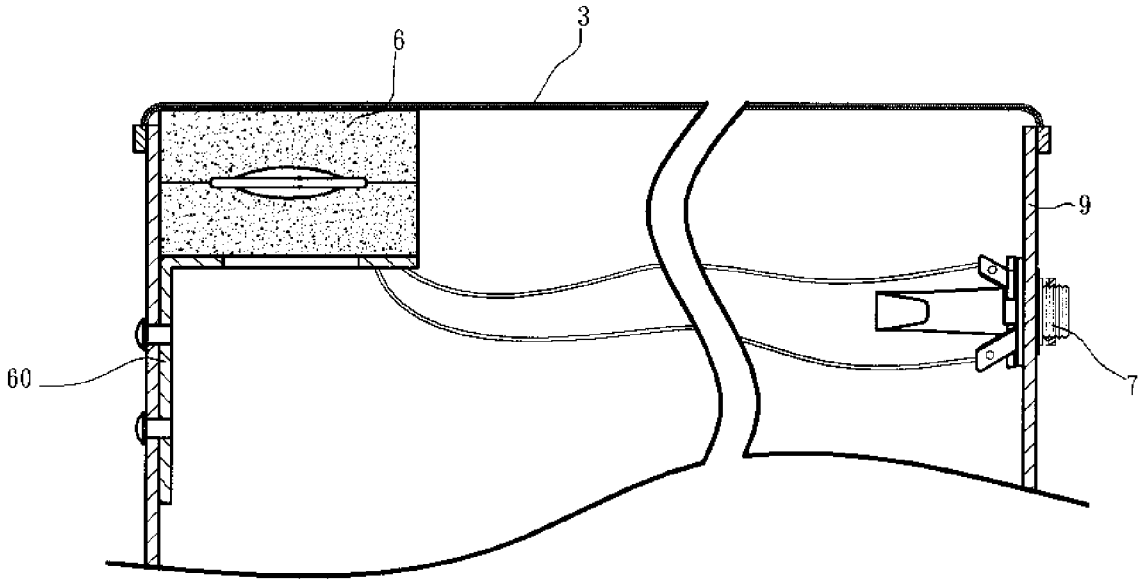
FIG. 11 is a cross sectional view of FIG. 10.

Referring to FIGS. 10 and 11, another way for combining the low-noise drum tympan 3 of the present invention to a pickup device 6 is illustrated. In that, the pickup device 6 with a supporting seat 61 is installed to a drum body 9. The connector 7 of the pickup device is wired-connected to another position of the drum body 9.

The present invention is thus described it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An enhanced low-noise drum tympan, comprising at least two net bodies which are combined to a drum frame; the net bodies being combined by adhesive and being rolled as an integral body; and wherein the net bodies are the combination of knitted fabrics nets and woven fabrics nets;

wherein the knitted fabrics net is formed by intersection of wide fabric strips and narrow fabric wires; in that the wide fabric strips are arranged in parallel and the narrow fabric wires are arranged in parallel; and the wide fabric strips are approximately vertical to the narrow fabric strips.

* * * * *